United States Patent [19]

Sassak

[11] Patent Number: 4,573,938

[45] Date of Patent: Mar. 4, 1986

[54] SPACESHIP TYPE TOY

[76] Inventor: Mark S. Sassak, 2405 Arends, Las Vegas, Nev. 89102

[21] Appl. No.: 583,657

[22] Filed: Feb. 27, 1984

[51] Int. Cl.[4] ..... A63H 33/40; A63H 17/00; A63H 27/00

[52] U.S. Cl. ..... 446/179; 446/178; 446/7; 446/231

[58] Field of Search ..... 446/7, 176, 177, 178, 446/179, 225, 230, 231, 444, 462, 463, 464, 465, 466, 467, 468, 469, 470, 471

[56] References Cited

U.S. PATENT DOCUMENTS

| | | | |
|---|---|---|---|
| 2,074,363 | 3/1937 | Burke | 446/179 X |
| 2,890,537 | 6/1959 | Benko | 446/178 X |
| 2,924,033 | 2/1960 | Lanctot | 446/178 X |
| 3,465,471 | 9/1969 | Friedman | 446/179 |
| 3,500,579 | 3/1970 | Bryer | 446/462 |
| 4,045,906 | 9/1977 | Goldfarb et al. | 446/179 |
| 4,057,929 | 11/1977 | Ogawa | 446/462 X |
| 4,211,412 | 6/1980 | Barlow et al. | 446/179 X |
| 4,250,657 | 2/1981 | Barlow et al. | 446/178 |
| 4,265,047 | 5/1981 | Meyer et al. | 446/7 |
| 4,292,755 | 10/1981 | Houn | 446/176 |

*Primary Examiner*—Robert A. Hafer
*Assistant Examiner*—D. Neal Muir
*Attorney, Agent, or Firm*—Harness, Dickey & Pierce

[57] ABSTRACT

A spaceship type toy is disclosed employing a lower base assembly, a duct, and a generally spherical toy space capsule closely received by the tube. A fan assembly within the base provides air pressure to the lower portion of the duct which, when sufficiently great, causes the toy capsule to translate within the tube, thus simulating space travel over a limited distance. By providing an adjustable electrical power supply to the fan assembly, the position of the capsule within the tube can be controlled by the user. In accordance with another feature of this invention, within the capsule is a seat which supports a toy astronaut figure. This seat can be rotated between two positions, which causes an electrical switching action upon a visual display within the spacecraft. The toy astronaut figure chair is further movable to expose a battery compartment within the spacecraft. Additional embodiments of this invention include a modified tube structure enabling a pair of base and fan assemblies to be connected at each end, thereby providing control over the movement of the capsule from one point to another.

10 Claims, 11 Drawing Figures

SPACESHIP TYPE TOY

BACKGROUND AND SUMMARY OF THE INVENTION

This invention relates to a toy, and particularly, to a fantasy toy simulating a spaceship.

Toys are often used by children and adults as a means of occupying leisure time, to develop creativity, and as teaching aids. Certain types of toys may be termed fantasy toys since they permit the user to enact situations which they otherwise could not (or should not) partake in, such as outer space, western or warfare adventures. For these types of toys, it is desirable to provide a central object with which toy figures are used. It is further desirable to provide some type of activity, such as movement or visual displays to further interest the user.

In view of the foregoing, it is a principal object of this invention to provide a spaceship type toy which employs a toy space capsule which is controllably movable. It is a further object of this invention to provide a toy space capsule which includes an internally positioned toy astronaut figure and a number of visual displays simulating an operational spaceship. It is another object of this invention to provide a means for controlling the movement of the toy space capsule. It is yet another object of this invention to provide a spaceship type toy assembly which can be compactly packaged, thereby providing good shipping and storage efficiency.

The above principal aspects of this invention are provided by a spaceship type toy having a generally spherical toy space capsule which is closely received by an elongated transparent tube. The tube has an enclosed lower end where it is attached to a base assembly. Within the base assembly is a fan assembly which provides positive air pressure to the lower end of the tube, thus causing the space capsule to become suspended within the tube. The fan assembly is energized by a variable output power supply, enabling the user to control the position of the capsule within the tube. In accordance with alternate embodiments of this invention, the tube structure can be elongated and formed into loops or other configurations with base assemblies positioned at each end. When both of the fan assemblies are independently controlled, the position of the capsule can be controlled by the users.

Additional features of this invention include a novel configuration for a toy space capsule having a toy astronaut seat which, when moved between two positions, controls a visual display. The toy astronaut seat is further movable to provide access to a battery compartment within the capsule.

Additional benefits and advantages of the present invention will become apparent to those skilled in the art to which this invention relates from the subsequent description of the preferred embodiments of this invention and the appended claims, taken in conjunction with the accompanying drawings.

DETAILED DESCRIPTION OF THE INVENTION

Figure 1:
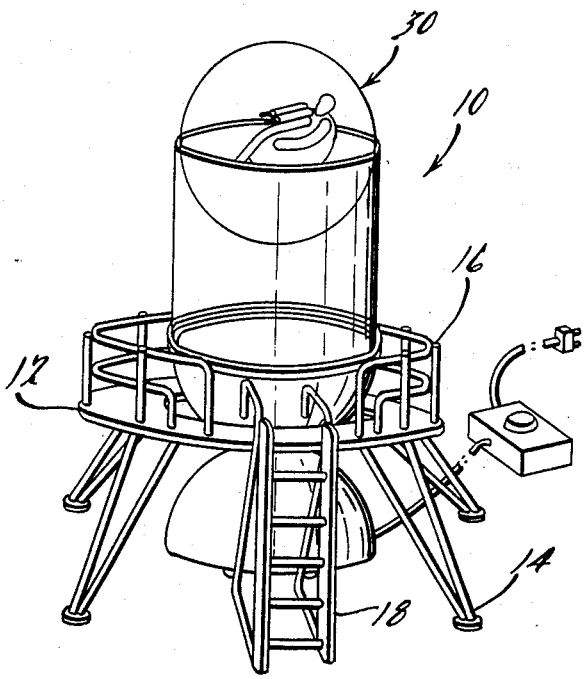
FIG. 1 is a pictorial view of a spaceship type toy assembly according to this invention.
Figure 2:
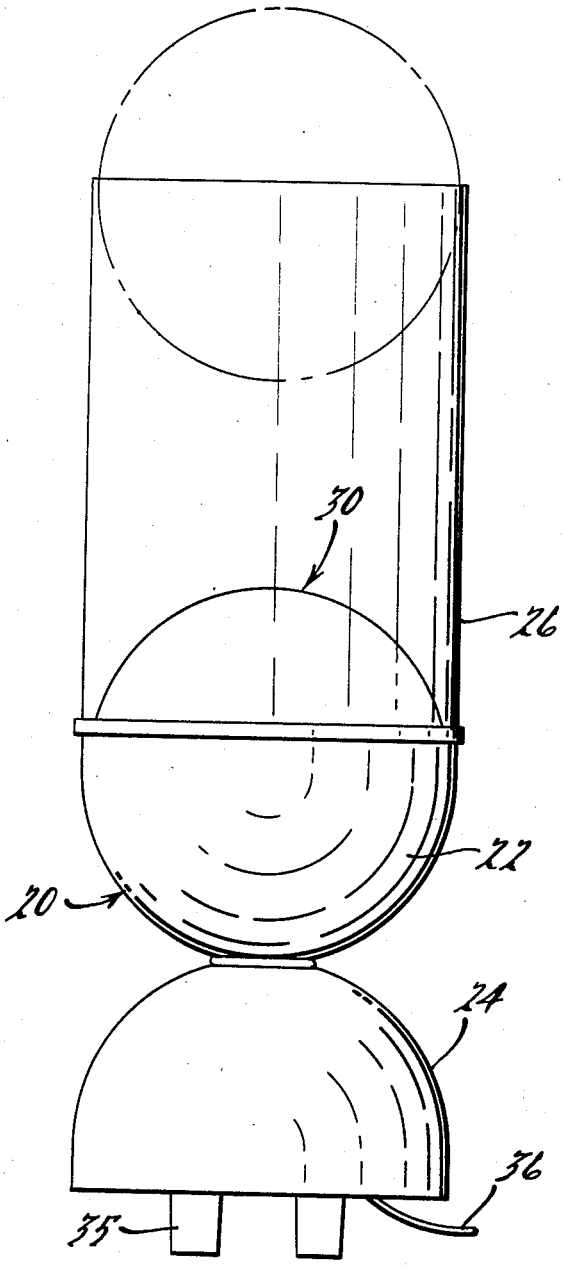
FIG. 2 is a side view of the toy space capsule tube, and base assembly of the toy according to this invention illustrating the toy space capsule in first and second positions.
Figure 3:
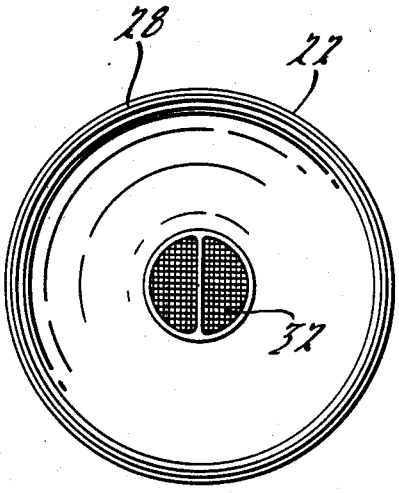
FIG. 3 is a top view of the base assembly according to this invention.
Figure 4:
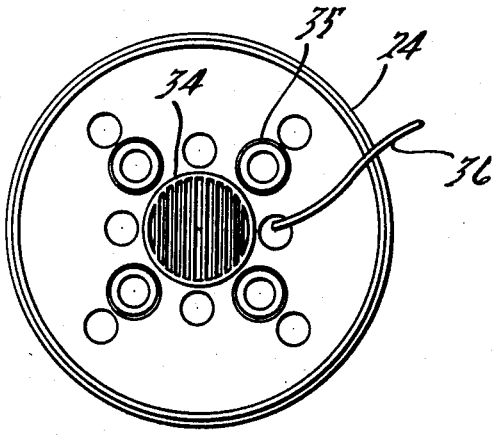
FIG. 4 is a bottom view of the base assembly of this invention.

A spaceship type toy according to this invention is shown particularly by FIG. 1 and is generally designated by reference character 10. The toy comprises a central assembly surrounded by platform 12 which includes a plurality of legs 14 and circumferntially oriented rails 16. Ladder 18 is positioned near platform 12 so that toy figures (not shown) may be caused to climb the ladder and may be positioned on platform 12 during use of the toy. The central assembly is shown particularly by FIG. 2 and includes base assembly 20 having upper base portion 22 and lower base portion 24. An elongated cylindrical transparent tube 26 is attached to upper base portion 24 by flange 28. A substantially spherical shaped spacecraft 30 is inserted within tube 26 and normally resides in the lower position illustrated by solid lines in FIG. 2. FIG. 3, which is a top view of upper base portion 22, shows outlet screen 32 fixed to the upper base portion. FIG. 4 is a bottom view of the base assembly 20 and shows inlet screen 34, foot pegs 35 and power supply lead 36.

Figure 5:
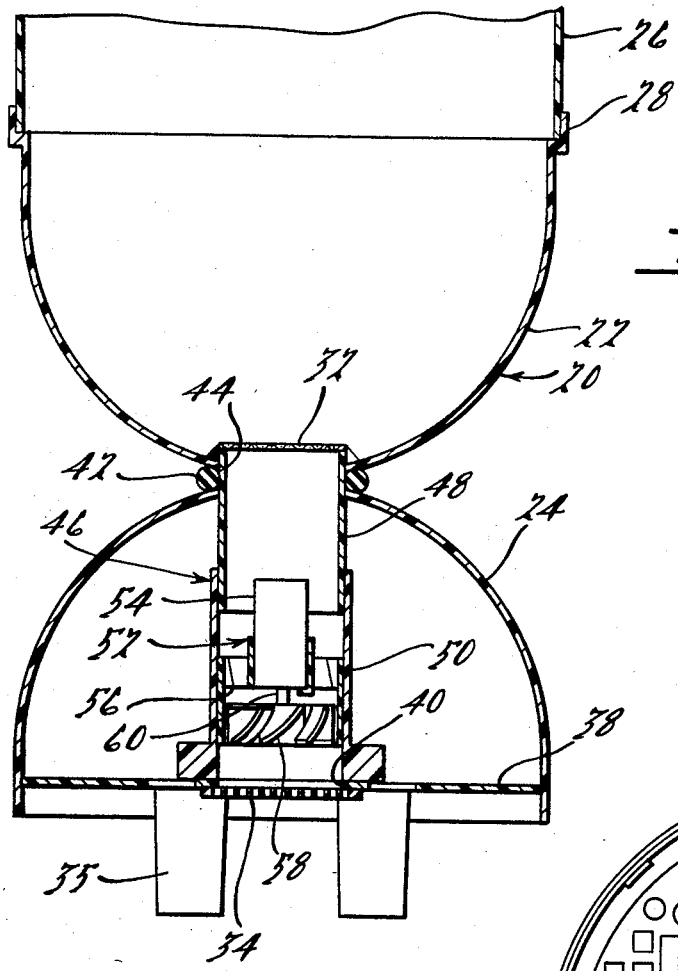
FIG. 5 is a cross-sectional view of the base assembly of this invention, particularly showing the internal components therein.

The internal components of base assembly 20 are shown particularly by FIG. 5. Within lower base portion 24 is bottom panel 38 which supports foot pegs 35 and defines central aperture 40. Upper and lower base portions 22 and 24 are formed from inverted half-spheres which are joined by collar 42 and define a central aperture 44. Disposed between apertures 40 and 44 is fan duct assembly 46. Fan duct assembly 46 is made up of two telescopingly interfitting duct portions, upper duct portion 48 and lower duct portion 50. Within duct portion 50 is disposed fan assembly 52 comprising electric motor 54 which is positioned by supports 56 and which is connected to axial flow fan 58 by shaft 60. Supports 56 are preferably designed such as not to impose a significant airflow restriction within the annular cavity around electric motor 54. Fan assembly 52, as shown, is of the type normally used within currently available portable electric hair dryers. Upper duct portion 48 telescopes within lower duct portion 50 such that fan duct assembly 46 extends between apertures 50 and 44. At each end of fan duct assembly 46 are screens which prevent ingestion of large particles and prevent access to the moving fan. Outlet screen 32 is located at the upper end of fan duct assembly 46, whereas inlet screen 34 is disposed at the bottom portion of the fan duct assembly. Power supply leads 36 provide electrical current to motor 54. Motor 54 is preferably of the universal variety which may be speed modulated by providing a variable voltage DC power supply.

In operation, rotation of axial flow fan 58 causes air to flow into inlet screen 34 and out from outlet screen 32, thus increasing the air pressure in upper base portion 22. When sufficient air pressure is provided, toy space capsule 30 is caused to translate vertically upward. This motion occurs when the difference in air pressure between the upper and lower portions of the capsule, which when acting on the cross-sectional area of the capsule, produces a force which exceeds the weight of the capsule. As shown in FIG. 2, capsule 30 may be caused to rise within tube 26 until the position shown in phantom lines is reached. Unless fan assembly 52 has an extremely high air flow capability, the upper position of capsule 36 shown by FIG. 2 is the highest position which the capsule can rise to, since the output of the blower assembly is no longer confined above the end of tube 26. A small annular gap is preferably provided between capsule 30 and the inner diameter of tube 26. This annular gap provides a degree of controlled air leakage which enables control over the vertical position of capsule 30.

It is within the scope of this invention to provide alternate means for providing air pressure to upper base portion 22. For example, a manually energized fan assembly could be installed within base assembly 20. For such a design, modulation of air pressure could be achieved by the speed at which a crank handle is rotated.

Figure 6:
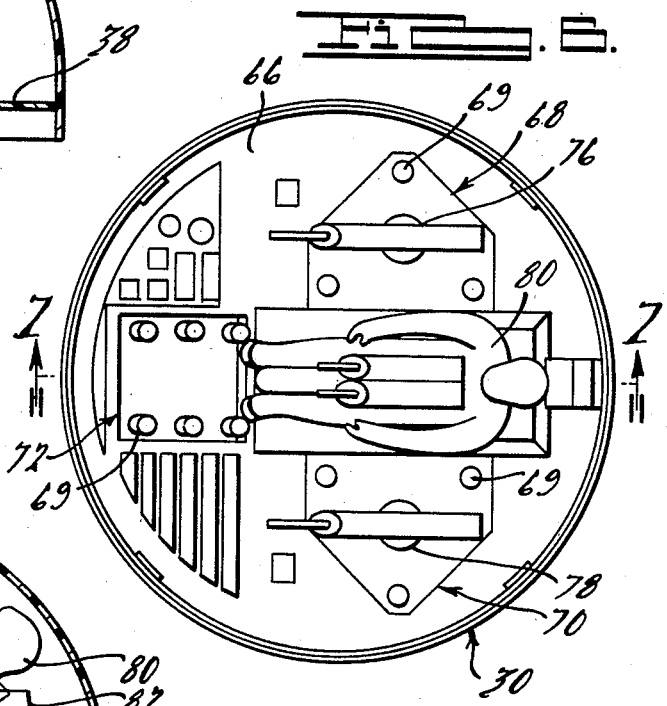
FIG. 6 is a top view of the toy space capsule according to this invention.
Figure 7:
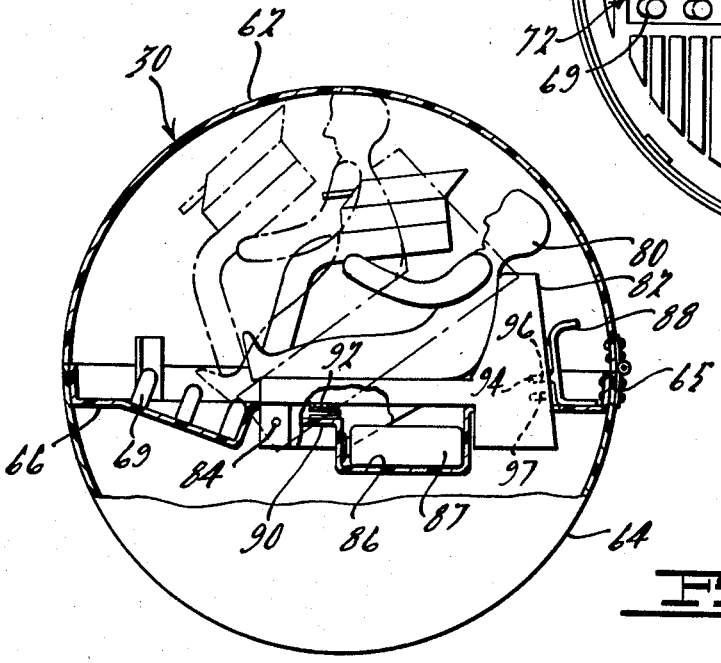
FIG. 7 is a cross-sectional view taken along line 7—7 of FIG. 6 further illustrating the internal components of the toy space capsule.

Details of construction of toy space capsule 30 are shown in FIGS. 6 and 7. Capsule 30 is formed by two half-sphere shell portions 62 and 64 which may be connected by hinge 65. These shell portions are held together by a flange fitting (not shown) therebetween. Upper space capsule portion 62 is preferably made of a transparent material so that components within the capsule are visible. Lower capsule portion 64 includes bulkhead panel 66. Bulkhead panel 66 is decorated to resemble the interior of a spacecraft, including a number of gauge readouts and simulated instrumentation. A number of visual display light panels are provided, 68, 70 and 72, which, when activated, preferably cause a number of lights to blink intermittently or provide a random display output. Light display panels 68 and 70 preferably include a number of individual light bulbs 69 and are controlled by switches 76 and 78, which are preferably of the push-type and which are decorated with simulated laser or projectile guns.

Supported by lower spacecraft portion 64 is toy astronaut figure 80 positioned within seat 82. Seat 82 is hinged for rotation with respect to bulkhead panel 66 about pivot pin 84. Beneath seat 82 is battery compartment 86 which provides a location for mounting of conventional batteries. The position of seat 82 is established by latch 88 which permits the seat to be moved between two positions. Movement between these two positions also causes current flow to display panel 72 to be supplied or interrupted as desired. The switching feature results from the location of electrical contacts 90 and 92, such that when the seat is in its lowermost position, the contacts cause the electric circuit with display panel 72 to be closed, thereby activating visual display 72. Latch 88 includes a protruding engaging portion 94 which fits within notch 96 of seat 82. By slightly deflecting latch 88, thereby withdrawing engaging portion 94 from notch 96, the seat may be moved to a new rotated position where the latch engages notch 97 and electrical contacts 90 and 92 become separated. Thus, movement of seat 82 between positions wherein engaging portion 94 engages notch 96 or 97 produces a switching effect upon visual display 72. By rotating seat 82 as full as possible to the position indicated by phantom lines in FIG. 7, access to battery compartment 86 is provided, thereby permitting removal and replacement of battery 87. In order to ensure that capsule 30 assumes the desired positioning within tube 26, such that upper spacecraft portion 62 is normally above lower spacecraft portion 64, it is necessary to orient the components within capsule 30 in such a way that the center of gravity of the capsule is located below the plane separating the upper and lower capsule portions.

Figure 8:
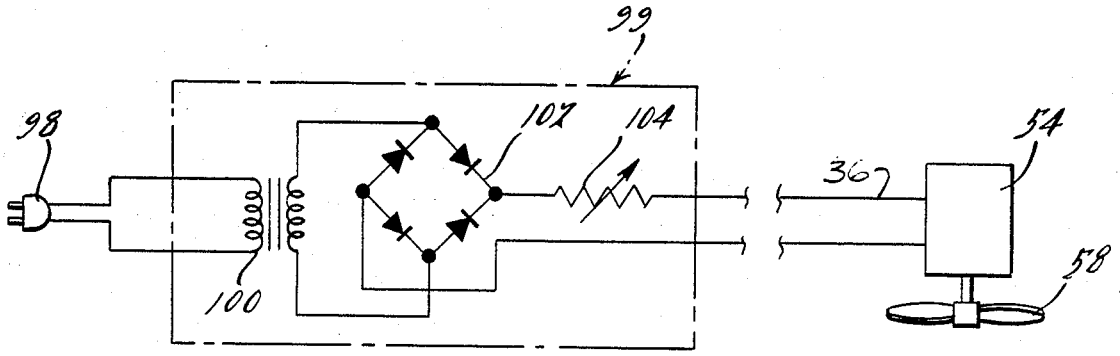
FIG. 8 is an electrical schematic drawing of the variable output power supply system employed with this invention.

FIG. 8 provides a schematic diagram of variable power supply system 99 preferably employed to energize electric motor 54. An AC power source 98 is conducted through stepdown transformer 100 to full wave bridge rectifier 102. The output of rectifier 102 is varied by passing it through variable resistance reostat 104. This arrangement provides a means for adjusting the electrical energy and consequently the air pressure acting upon capsule 30 to be adjustable. Numerous other types of power supplies could, of course, be used.

Figure 9:
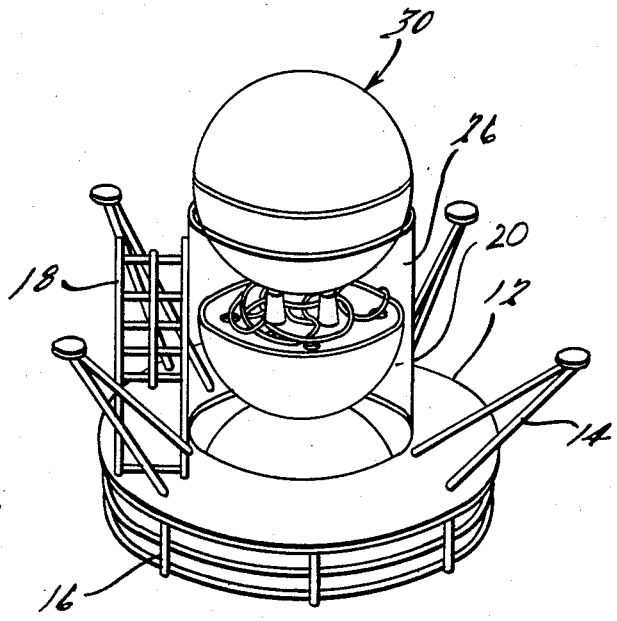
FIG. 9 is a pictorial view of the spaceship type toy assembly according to this invention wherein the components thereof are positioned for packaging.

FIG. 9 illustrates a preferred orientation of the components of toy 10 for most efficient packaging. As shown, base assembly 20 is first inverted and tube 26 is slid over the base assembly. In order that tube 26 may accommodate base assembly 20 in this manner, it is necessary to design lower base portion 24 so that its outside diameter is less than the inside diameter of the tube. Next, capsule 30 is positioned to rest on foot pegs 35. Sufficient space is provided around foot pegs 35 to allow power supply lead 36 to be coiled in that area. Platform 12 is then placed around tube 26 and may be inverted as shown by FIG. 9. Improvements in packaging efficiency results from designing legs 14 so that they are retractable or detachable.

Figure 10:
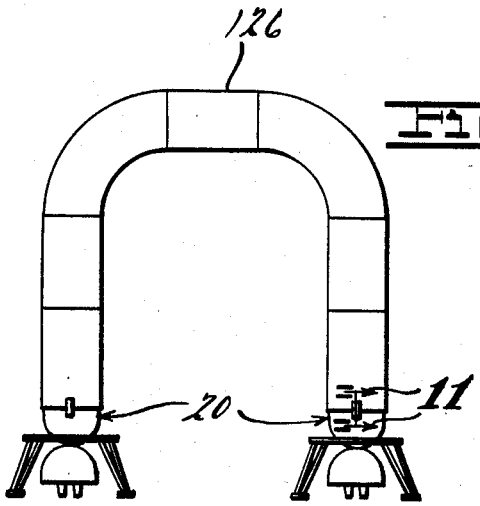
FIG. 10 is a second alternate embodiment of this invention employing a modified tube permitting two base assemblies to be positioned at opposing ends of the tube whereby the base assemblies may be used simultaneously.

Another form of this invention is shown by FIG. 10. This second embodiment employs another configuration for tube 126. This tube 126 forms an inverted "U" configuration permitting a pair of base assemblies 20 to be used to control the position of the spacecraft 30. Movement of capsule 30 results when the air pressure exerted by one fan assembly 52 exceed that exerted by the other. This configuration permits the users to enact situations wherein a toy astronaut travels from one "space station" to another. For this embodiment, tube 126 is fabricated by attaching a number of tube segments together. Due to this construction, various shapes of tube layouts could be assembled.

Figure 11:
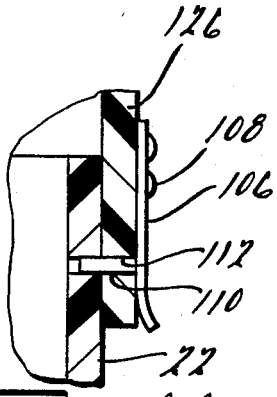
FIG. 11 is a cross-sectional view of a third alternate embodiment illustrating a modified system for connecting the tube to the base assembly.

FIG. 11 illustrates another means for attaching tube 126 to upper base portion 22. As illustrated, a resilient latch 106 is attached to tube 126 by mechanical fasteners 108. By deflecting latch 106, engaging portion 110 is caused to be withdrawn from bore 112 of upper base portion 22, enabling the tube to be slid with respect to base assembly 20.

While the above description constitutes the preferred embodiments of the present invention, it will be appreciated that the invention is susceptible to modification, variation and change without departing from the proper scope and fair meaning of the accompanying claims.

What is claimed is:

1. A spherical toy space capsule comprising an upper spherical portion, a lower spherical portion engaging said upper spherical portion, a toy seat structure disposed within said lower spherical portion and hinged for limited rotation between first and second positions, battery means disposed within said lower spherical portion, visual display means disposed within said lower spherical portion, said visual display means energizable by said battery means, and switch means operatively associated with said toy seat structure such that said switch changes from a closed to an open state when said toy seat structure is moved from said first to said second positions, thereby controllably energizing said visual display means.

2. A toy space capsule according to claim 1 further comprising a battery compartment formed by said lower spherical portion, said toy seat structure further movable to a third position which permits access to said battery compartment.

3. A toy space capsule according to claim 1 wherein said upper spherical portion is a substantially transparent shell.

4. The spherical toy space capsule according to claim 1 further comprising an elongated tube closely receiving said toy space capsule, and fan means supplying air pressure at one end of said tube, said air pressure acting upon said capusle such that said capsule is translatable within said tube.

5. The spherical toy space capsule according to claim 4 further comprising said fan means being controllably energized thereby permitting modulation of said air pressure acting upon said capsule.

6. The spherical toy space capsule according to claim 5 wherein said tube is curved to form two ends adjacent substantially vertical sections, and a second base connected to one of said tube ends, said second base including a second fan means installed therein.

7. The spherical toy space capsule according to claim 4 further comprising a battery compartment formed by said lower spherical portion, said toy seat structure further movable to a third position which permits access to said battery compartment.

8. The spherical toy space capsule according to claim 1 further comprising an elongated tube closely receiving said toy spacecraft having two opened ends, and a pair of fan means supplying air pressure to said tube ends, said air pressure acting upon said toy spacecraft such that said toy spacecraft is translatable within said tube.

9. A spaceship type toy comprising, in combination:

a space capsule including an upper spherical portion, a lower spherical portion engaging said upper spherical portion, a toy seat structure disposed within said lower spherical portion and hinged for limited rotation between first and second positions, battery means disposed within said lower spherical portion, visual display means disposed within said lower spherical portion, said visual display means energizable by said battery means, and switch means operatively associated with said toy seat structure such that said switch changes from a closed to an open state when said toy seat structure is moved from said first to said second positions, thereby controllably energizing said visual display means, an elongated tube oriented substantially vertically, said tube closely receiving said capsule, a base supporting said tube, a fan duct installed within said base and communicating with the vertically lower end of said tube, and fan means installed within said fan duct, said fan means supplying air pressure to said tube such that said capsule is translatable within said tube.

10. A spaceship type toy comprising, in combination:

a space capsule including an upper spherical portion, and a lower spherical portion engaging said upper spherical portion, an elongated tube oriented substantially vertically, said tube closely receiving said capsule and having an upper opened end, defined by a perimenter edge lying substantially along a horizontal plane a base supporting said tube, a fan duct installed within said base and communicating with the vertically lower end of said tube, and fan means installed within said fan duct, said fan means supplying air pressure to said tube such that said capsule may be translated within said tube to said upper end of said tube such that a portion of said capsule extends above said perimeter edge, while a remaining portion of said capsule remains within said tube.

* * * * *

UNITED STATES PATENT AND TRADEMARK OFFICE

CERTIFICATE OF CORRECTION

PATENT NO. : 4,573,938

DATED : March 4, 1986

INVENTOR(S) : Mark S. Sassak

It is certified that error appears in the above-identified patent and that said Letters Patent is hereby corrected as shown below:

Column 2, line 34; "circumferntially" should be --circumferentially--

Column 3, line 2; "50" should be --40--

Column 5, line 35; "capusle" should be --capsule--

Column 6, line 38; "perimenter" should be --perimeter--

Signed and Sealed this

*Eighth* Day of *July 1986*

[SEAL]

*Attest:*

*Attesting Officer*

DONALD J. QUIGG

*Commissioner of Patents and Trademarks*